US009890567B2

(12) United States Patent
Yu

(10) Patent No.: US 9,890,567 B2
(45) **Date of Patent: *Feb. 13, 2018**

(54) PADLOCK WITH INDICATION DEVICE

(71) Applicant: Chun Te Yu, Changhua County (TW)

(72) Inventor: Chun Te Yu, Changhua County (TW)

( * ) Notice: Subject to any disclaimer, the term of this patent is extended or adjusted under 35 U.S.C. 154(b) by 66 days.

This patent is subject to a terminal disclaimer.

(21) Appl. No.: 14/705,510

(22) Filed: May 6, 2015

(65) Prior Publication Data

US 2015/0233148 A1 Aug. 20, 2015

Related U.S. Application Data

(63) Continuation of application No. 13/541,855, filed on Jul. 5, 2012, now abandoned, which is a continuation of application No. 12/814,183, filed on Jun. 11, 2010, now Pat. No. 8,256,250, which is a continuation-in-part of application No. 11/491,258, filed on Jul. 24, 2006, now Pat. No. 7,770,421, which is a continuation-in-part of application No. 11/032,116, filed on Jan. 11, 2005, now Pat. No. 7,100,401.

(30) Foreign Application Priority Data

Nov. 23, 2004 (TW) ..... 93218813 U

(51) Int. Cl.
*E05B 67/06* (2006.01)
*E05B 39/00* (2006.01)

(52) U.S. Cl.
CPC ..... *E05B 67/06* (2013.01); *E05B 39/00* (2013.01); *Y10T 70/413* (2015.04)

(58) Field of Classification Search
CPC ..... E05B 37/0031; E05B 37/0034; E05B 37/0037; E05B 67/06; E05B 39/00; E05B 37/0041; E05B 37/025; E05B 17/145; E05B 35/105; E05B 41/00; Y10T 70/413
USPC ..... 70/20
See application file for complete search history.

(56) References Cited

U.S. PATENT DOCUMENTS

| | | | | |
|---|---|---|---|---|
| 827,177 A | | 7/1906 | Pixley | |
| 972,171 A | | 10/1910 | Dupont | |
| 1,411,123 A | * | 3/1922 | Nadolny | E05B 37/025 70/25 |
| 1,819,813 A | | 8/1931 | Ellenberger | |
| 2,395,762 A | | 2/1946 | Rober | |
| 3,808,848 A | | 5/1974 | Yang | |

(Continued)

*Primary Examiner* — Christopher J Boswell
*Assistant Examiner* — Amanda L Bailey
(74) *Attorney, Agent, or Firm* — Muncy, Geissler, Olds & Lowe, P.C.

(57) ABSTRACT

A padlock includes a shell, a shackle, a limit knob, an indicator and a lock core. The shell includes an opening in a wall thereof. The shackle includes a long section movably inserted in the shell, and a short section extended from the long section and located out of the shell. The limit knob is partly received in the shell via the opening and includes a button located out of the shell. The indicator is disposed on the limit knob and capable of moving to a predetermined position which is out of the shell. The lock core includes a rotor configured to be driven by a key so as to move the limit knob to a first position where the button of the limit knob keeps the shackle from rotating and a second position where the button of the limit knob allows the shackle to rotate.

8 Claims, 12 Drawing Sheets

(56) References Cited

U.S. PATENT DOCUMENTS 3,824,819 A * 7/1974 Neary ..... E05B 41/00 70/432
3,837,189 A 9/1974 Atkinson
5,377,511 A * 1/1995 Meckbach ..... E05B 67/063 70/371
6,047,577 A * 4/2000 Klimas ..... E05B 35/08 70/340
6,516,643 B1 * 2/2003 Olshausen ..... E05B 27/0053 70/337
6,877,345 B1 * 4/2005 Misner ..... E05B 35/105 70/25
6,997,023 B1 2/2006 Huang
7,007,521 B1 3/2006 Misner et al.
7,047,773 B1 5/2006 Lin
7,100,401 B2 9/2006 Yu
7,114,356 B1 10/2006 Yu
7,140,209 B2 11/2006 Lai
7,159,422 B1 1/2007 Misner et al.
7,204,108 B2 4/2007 Yu
7,210,318 B2 5/2007 Yu
7,216,517 B2 5/2007 Ling et al.
7,225,648 B2 6/2007 Lai et al.
7,340,927 B2 3/2008 Yu et al.
7,357,007 B2 4/2008 Lin
7,363,782 B1 4/2008 Misner et al.
7,370,497 B2 5/2008 Yu
7,434,426 B2 10/2008 Loughlin et al.
7,493,785 B2 2/2009 Yu et al.
7,520,150 B2 4/2009 Yu
7,523,628 B2 4/2009 Yu
7,562,545 B2 7/2009 Lai et al.
7,628,045 B2 12/2009 Yu
7,770,421 B2 8/2010 Yu
7,779,657 B2 8/2010 Yu
7,934,406 B2 5/2011 Loughlin et al.
2002/0088256 A1 7/2002 Taylor et al.
2004/0226323 A1 * 11/2004 Ling ..... E05B 37/0034 70/25
2004/0226324 A1 11/2004 Loughlin et al.
2005/0034492 A1 2/2005 Yu
2005/0039500 A1 2/2005 Yu
2005/0039501 A1 2/2005 Yu
2005/0044901 A1 3/2005 Yu
2005/0092036 A1 5/2005 Lai
2005/0126233 A1 6/2005 Yu
2005/0132762 A1 6/2005 Yu
2005/0235706 A1 10/2005 Ling et al.
2005/0262902 A1 12/2005 Ling et al.
2006/0107709 A1 5/2006 Yu
2006/0107710 A1 5/2006 Yu
2006/0130540 A1 6/2006 Lin
2006/0225469 A1 10/2006 Yu
2006/0260369 A1 11/2006 Lai et al.
2007/0227202 A1 10/2007 Yen et al.
2007/0271969 A9 11/2007 Yu et al.
2008/0011026 A1 1/2008 Huang
2008/0016922 A1 1/2008 Yu
2008/0060390 A1 3/2008 Yu et al.
2008/0098774 A1 5/2008 Huang
2008/0156046 A1 7/2008 Yu
2008/0178649 A1 7/2008 Yu
2008/0307839 A1 12/2008 Yu
2009/0031764 A1 2/2009 Huang
2009/0113947 A1 5/2009 Lai et al.
2009/0188282 A2 7/2009 Loughlin et al.
2010/0037663 A1 2/2010 Yu
2010/0095718 A1 4/2010 Lai et al.
2010/0242551 A1 9/2010 Yu
2010/0307204 A1 12/2010 Yu
2011/0138865 A1 6/2011 Loughlin et al.

* cited by examiner

PADLOCK WITH INDICATION DEVICE

CROSS REFERENCE TO RELATED APPLICATIONS

This is a continuation of co-pending application Ser. No. 13/541,855, filed Jul. 5, 2012, which is a continuation of application Ser. No. 12/814,183, filed Jun. 11, 2010, which issued as U.S. Pat. No. 8,256,250 on Sep. 4, 2012, which is a continuation-in-part of U.S. application Ser. No. 11/491,258, filed on Jul. 24, 2006, which issued as U.S. Pat. No. 7,770,421 on Aug. 10, 2010, which is a continuation-in-part of U.S. application Ser. No. 11/032,116 filed on Jan. 11, 2005, which issued as U.S. Pat. No. 7,100,401 on Sep. 5, 2006, for which priority is claimed under 35 U.S.C. § 120; and this application claims priority of Application No. 093218813 filed in Taiwan, R.O.C. on Nov. 23, 2004 under 35 U.S.C. § 119; the entire contents of all of which are hereby incorporated by reference.

BACKGROUND OF THE INVENTION

1. Field of the Invention

The present invention relates to a padlock and, more particularly, to a padlock with an indication device for reminding a padlock owner whose padlock has been operated or used and luggage may have been inspected by the customs.

2. Brief Description of the Related Art

A conventional dual lock or padlock generally includes a shell, a shackle installed on the shell, a first locking mechanism installed on the shell to lock and unlock the shackle, and a second locking mechanism installed on the shell to lock and unlock the shackle. The first locking mechanism can only be unlocked by a padlock owner while the second locking mechanism can be unlocked only by a specific key. The specified key is often held by a customs inspector who is authorized to unlock the second locking mechanism of the padlock when it is necessary to open and check a luggage, a case or a bag subject to the lock or padlock without breaking it. Then, the inspector can re-lock the lock or padlock via the second locking mechanism by the specified key after inspecting the luggage, case or bag. However, an owner of such a luggage, case or bag cannot judge by the appearance of the lock or padlock if the lock or padlock has been operated or used and the luggage, case or bag has been checked that would cause great inconvenience to the owner.

SUMMARY OF THE INVENTION

The primary objective of the present invention is to provide a padlock capable of reminding a padlock owner whose padlock has been operated or used and luggage may have been inspected by the customs.

In an embodiment of the present invention, a padlock comprises a shell, a shackle, a lock mechanism and an indicator. The shell includes an opening made in a wall thereof to communicate an interior space of the shell and the out of the shell. The shackle is mounted on the shell and formed with a long section movably inserted in the shell and a short section extending from the long section so that they are movable together. The lock mechanism is mounted on the shell, and includes a lock core and a limit knob. The lock core is inserted in the shell. The limit knob comprises a driving member and a button. The driving member is movable within the interior space of the shell via the opening. The button is coupled to the driving member and located out of the shell. The driving member is movable by the lock core so as to drive the button to engage with or disengage from the short section of the shackle. The indicator is disposed in the opening of the shell and capable of moving along a surface of the driving member from the opening of the shell to an indication position out of the shell by operating the lock core of the lock mechanism.

Further benefits and advantages of the present invention will become apparent after a careful study of the detailed description with reference to the accompanying drawings.

BRIEF DESCRIPTION OF THE DRAWINGS

The present invention will be described via detailed illustration of the preferred embodiment referring to the drawings wherein.

DETAILED DESCRIPTION OF THE PREFERRED EMBODIMENTS

FIGS. 1-10 show a padlock according to a first embodiment of the present invention. As shown in FIGS. 1-5, the padlock comprises a shell 1, a shackle 2, a lock mechanism 4, and an indicator 5. The lock mechanism 4 can be a key-operated lock mechanism or a combination lock mechanism. In the first embodiment, the lock mechanism 4 is a key-operated lock mechanism.

Figure 8:
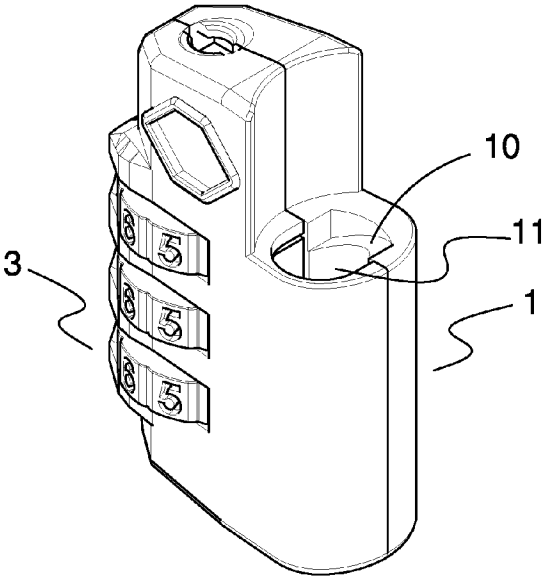
FIG. 8 is a perspective partial view of the padlock shown in FIG. 1.

In the first embodiment, the shell 1 includes an opening 11, as can be seen in FIG. 8, in a wall thereof to communicate an interior space of the shell 1 with the exterior of the shell 1. The shackle 2 is substantially U-shaped and mounted on the shell 1. The shackle 2 is formed with a long section 20 movably inserted in the shell 1 and a short section 21 extending from the long section 20 so that they are movable together.

The lock mechanism 4 is mounted on the shell 1, and includes a lock core 41 and a limit knob 40. The lock core 41 is inserted in the shell 1. The limit knob 40 comprises a driving member 404 and a button 405. The driving member 404 is movable within the interior space of the shell 1 via the opening 11 of the shell 1. The button 405 is coupled to the driving member 404 and located out of the shell 1. The driving member 404 is movable by the lock core 41 so as to drive the button 405 to engage with or disengage from the short section 21 of the shackle 2. Additionally, the button 405 of the limit knob 40 includes a top face formed with a recess 400 for receiving an end 210 of the short section 21 of the shackle 2. The recess 400 includes an open end at a periphery of the limit knob 40.

Moreover, the indicator 5 is inserted in the opening 11 of the shell 1 and is capable of moving along a surface of the driving member 404 from the opening 11 of the shell 1 into an indication position out of the shell 1 by operating the lock core 41 of the lock mechanism 4, as shown in FIGS. 5-10.

Figure 4:
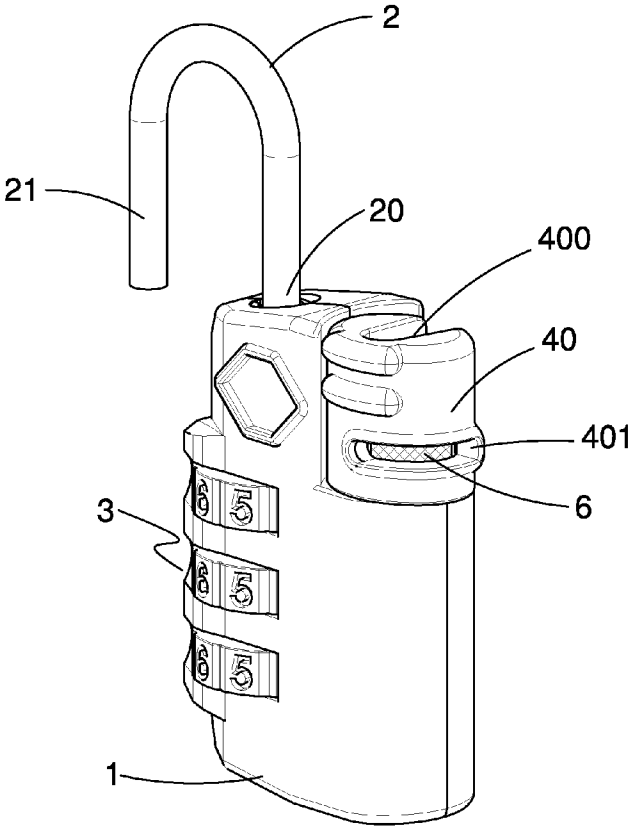
FIG. 4 is a perspective view of the padlock in another position than that is shown in FIG. 3.
Figure 6:
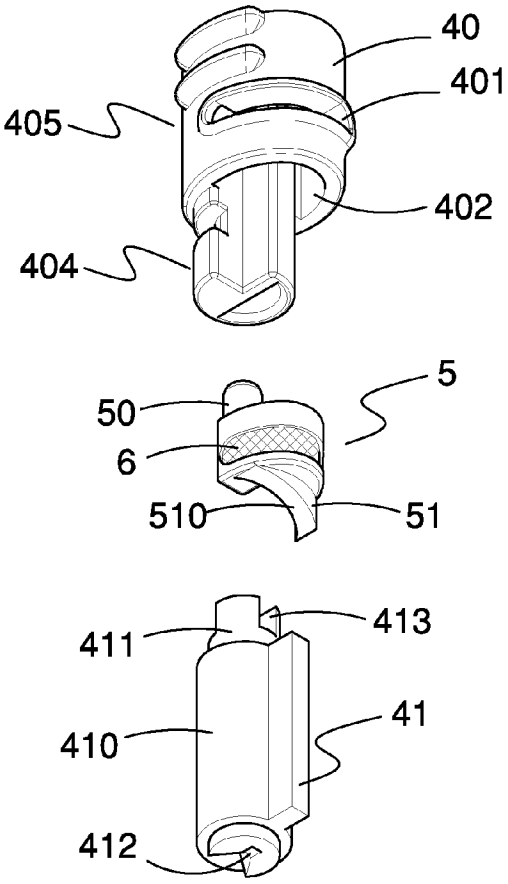
FIG. 6 is another exploded partial view of the padlock shown in FIG. 1.
Figure 5:
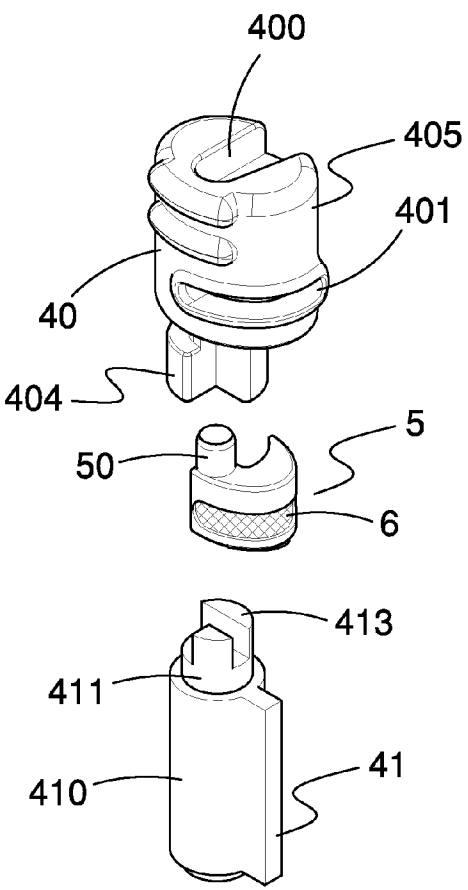
FIG. 5 is an exploded partial view of the padlock shown in FIG. 1.

Referring to FIGS. 4-6, the indicator 5 is formed with an indication portion 6. The button 405 of the limit knob 40 includes a window 401 made in the periphery. In the first embodiment, the indication portion 6 of the indicator 5 is visible from the window 401 of the button 405 when the indicator 5 is in the indication position.

As described above, the lock mechanism 4 is a key-operated lock mechanism. Accordingly, the lock core 41 of the lock mechanism 41 comprises a body 410 and a rotor 411. The rotor 411 is movably received in the body 410, and includes one end made with a keyhole portion 412, and the other end made with a driving portion 413 extending from the body 410 for connecting with the limit knob 40. The keyhole portion 412 of the rotor 411 is arranged for receiving a matching key (not shown). When the matching key is inserted into the keyhole portion 412, the driving portion 413 can accordingly move the limit knob 40.

In addition, the padlock further comprises a combination lock core 3, which is inserted in the shell 1 for locking and unlocking the long section 20 of the shackle 2, as shown in FIGS. 1-4.

Figure 2:
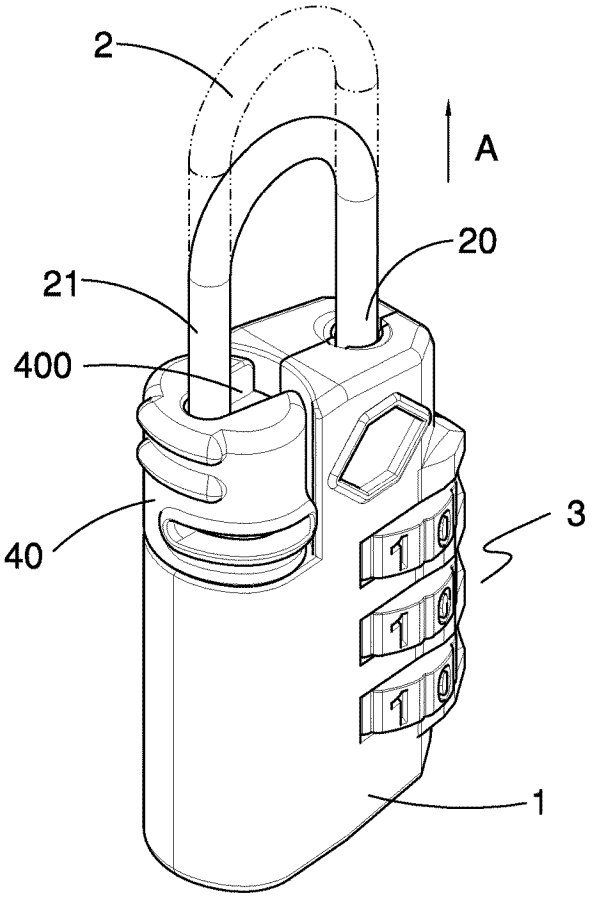
FIG. 2 is a perspective view of the padlock shown in FIG. 1.
Figure 1:
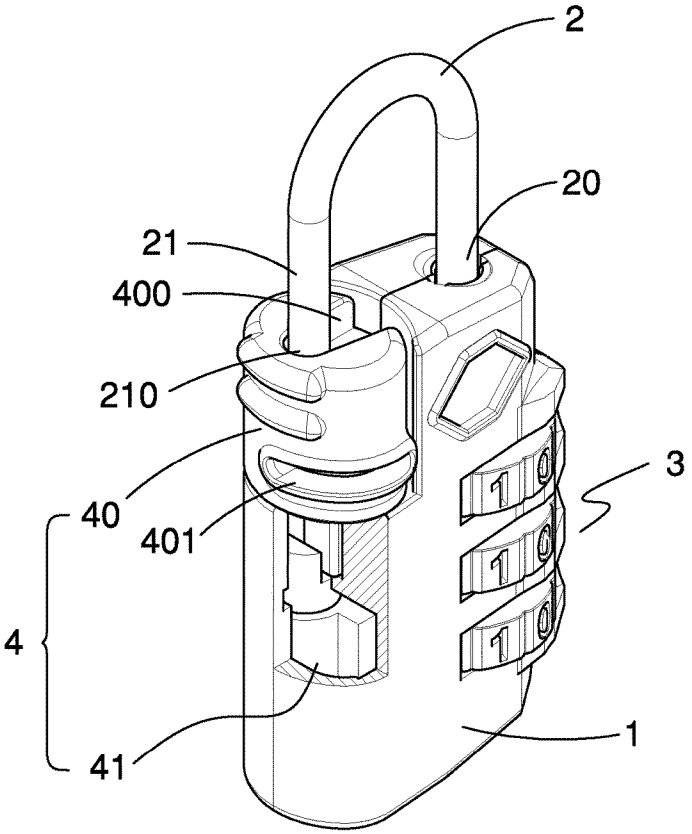
FIG. 1 is a cutaway view of a padlock in accordance with a first embodiment of the present invention.

FIG. 2 shows that the open end of the recess 400 of the limit knob 40 is directed toward and sealed by the shell 1, and the short section 21 of the shackle 2 is inserted in the recess 400 of the limit knob 40 of the lock mechanism 4 and stopped by the limit knob 40, thus forming a locked state. When the combination lock core 3 is unlocked, the long section 20 of the shackle 2 is unlocked from the combination lock core 3 so that the shackle 2 is movable in a direction indicated by an arrow head A, so as to detach the short section 21 of the shackle 2 from the recess 400 of the limit knob 40 of the lock mechanism 4, thereby forming an unlocked state.

Figure 3:
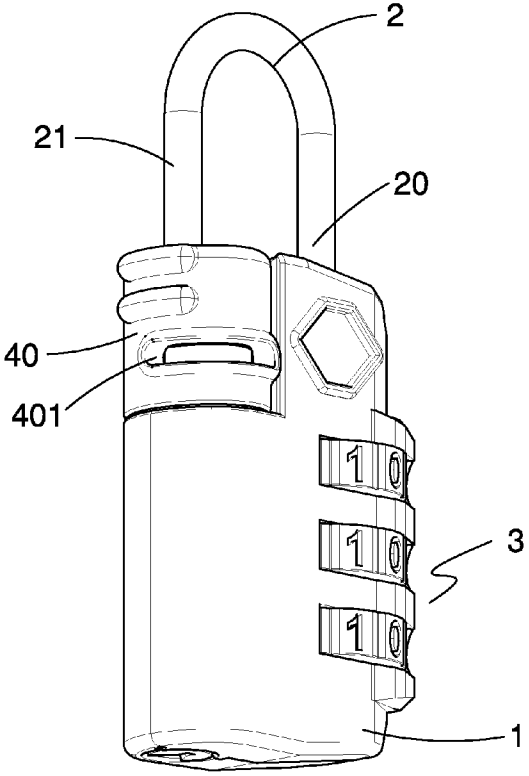
FIG. 3 is another perspective view of the padlock shown in FIG. 1.

Referring to FIG. 3, when the combination lock core 3 is locked, the long section 20 of the shackle 2 is locked by the combination lock core 3. That is, the short section 21 of the shackle 2 is stopped by the limit knob 40, thereby forming a locked state.

In FIG. 4, when the limit knob 40 of the lock mechanism 4 is moved by the lock core 41 via the matching key, the open end of the recess 400 of the limit knob 40 is released from the shell 1. Accordingly, the short section 21 of the shackle 2 is released from the recess 400 of the limit knob 40 and can be rotated about the long section 20 of the shackle 2, thereby forming an unlocked state.

FIG. 5 shows that the indicator 5 is movably mounted on the driving member 404 of the limit knob 40 of the lock mechanism 4 and includes a protruding portion formed on a first side and hereinafter named as the "shaft 50", directed toward the limit knob 40. The indication portion 6 of the indicator 5 and is visible from the window 401 of the limit knob 40 when the indicator 5 is in the indication position. Preferably, the indication portion 6 of the indicator 5 is a color, character, number or pattern. For examples, the indication portion 6 of the indicator 5 is printed in red, and the other portion of the indicator 5 is printed in green. Hence, the red of the indication portion 6 clearly visible from the window 401 presents the lock core 41 of the lock mechanism 4 is operated or used.

Figure 7:
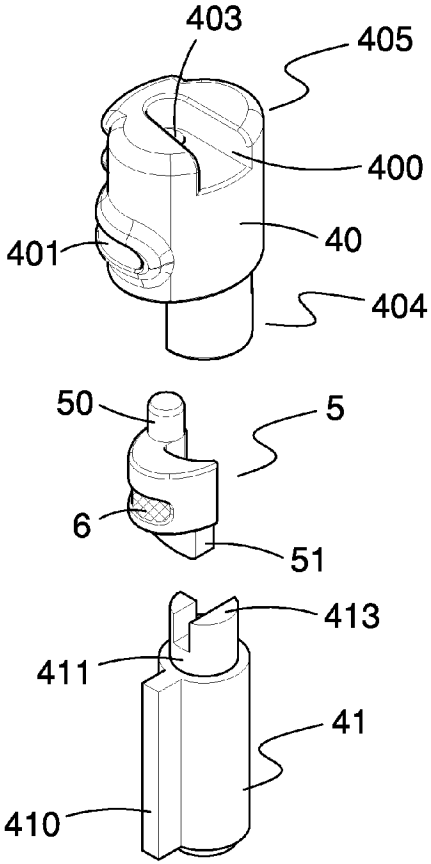
FIG. 7 is an exploded partial view of the padlock in another position than that is shown in FIG. 5.

Furthermore, FIGS. 6-8 show that the button 405 of the limit knob 40 is formed with a chamber 402 facing the shell 1 for receiving the indicator 5. The indicator 5 includes, on a second side, a guide portion 51 formed with a first ramp 510. The recess 400 of the limit knob 40 includes an aperture 403 in communication with the chamber 402. The shaft 50 of the indicator 5 can be inserted into the aperture 403 of the limit knob 40. Additionally, the shell 1 includes a second ramp 10 complementarily in contact with the first ramp 510 of the guide portion 51 of the indicator 5.

Figure 10:
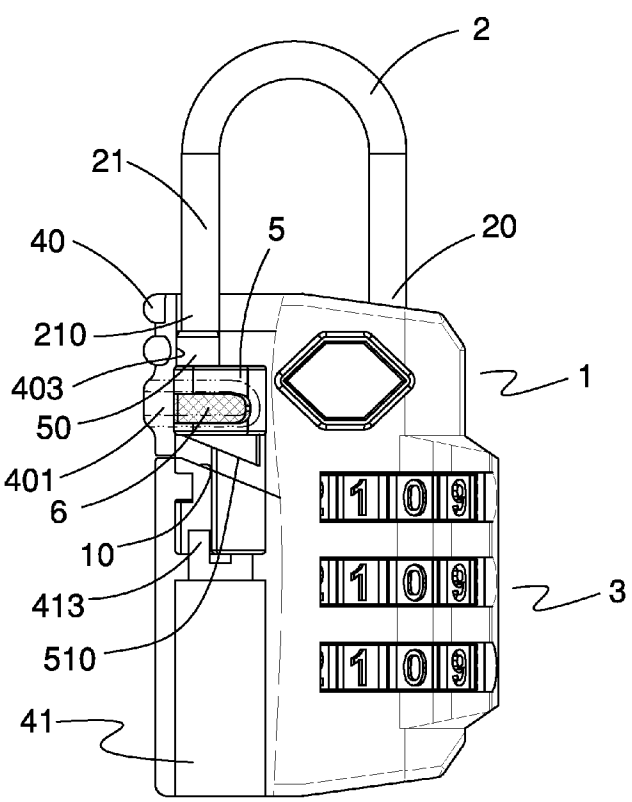
FIG. 10 is a side view of the padlock in another position than that is shown in FIG. 9.
Figure 9:
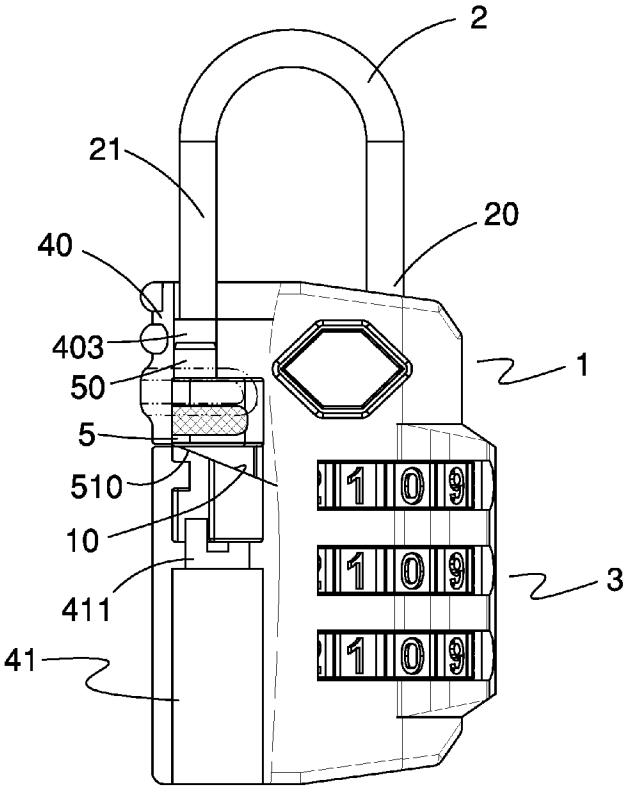
FIG. 9 is a side view of the padlock shown in FIG. 1.

Referring to FIG. 9, the first ramp 510 of the indicator 5 is in contact with the second ramp 10 of the shell 1 so that the indication portion 6 is hidden in the shell 1 and detached from the window 401 of the limit knob 40. Thus, it is indicated that the lock mechanism 4 has not been operated or used. Referring to FIG. 10, as the driving portion 413 of the rotor 411 of the lock mechanism 4 is rotated by the matching key, the limit knob 40 is rotated accordingly until the open end of the recess 400 of the limit knob 40 is released from the shell 1. Therefore, the short section 21 of the shackle 2 is released from the recess 400 of the limit knob 40 and is rotated freely about the long section 20 of the shackle 2 to the unlocked state. At this time, the shaft 50 of the indicator 5 is located further in the aperture 403 of the limit knob 40. Hence, the indicator 5 is driven by the limit knob 40 when the limit knob 40 is rotated by the lock core 41. The indicator 5 is lifted to the indication position by engagement of the first ramp 510 of the indicator 5 with the second ramp 10 of the shell 1 so that the indication portion 6 is exposed and visible from the window 401 of the limit knob 40.

After the limit knob 40 is again rotated by the lock core 41 to re-lock the short section 21 of the shackle 2, the indicator 5 is limited by the chamber 402 and the aperture 403 of the limit knob 40 so that the indicator 5 is not moved along with the driving member 404 of the limit knob 40, i.e., the indicator 5 is kept in the indication position. Thus, it is indicated that the lock mechanism 4 has been operated. Additionally, as the combination lock core 3 is unlocked, the end 210 of the short section 21 of the shackle 2 can be pushed into the aperture 403 of the limit knob 40 so as to push the shaft 50 of the indicator 5 downward to move the indicator 5 away from the indication position, namely to reset the indication portion 6. Alternatively, the shackle 2 can be pulled outward and rotated away from the limit knob 40 so as to allow an insert (not shown) inserting into the aperture 403 of the limit knob 40 to push the shaft 50 of the indicator 5 downward, thus moving the indicator 5 away from the indication position.

Figure 11:
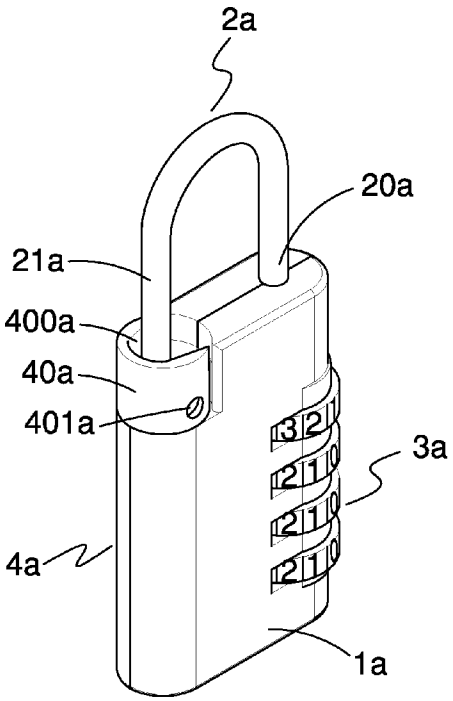
FIG. 11 is a perspective view of a padlock in accordance with a second embodiment of the present invention.

Referring to FIG. 11, a padlock in accordance with a second embodiment of the present invention includes a structure like that of the first embodiment.

Figure 12:
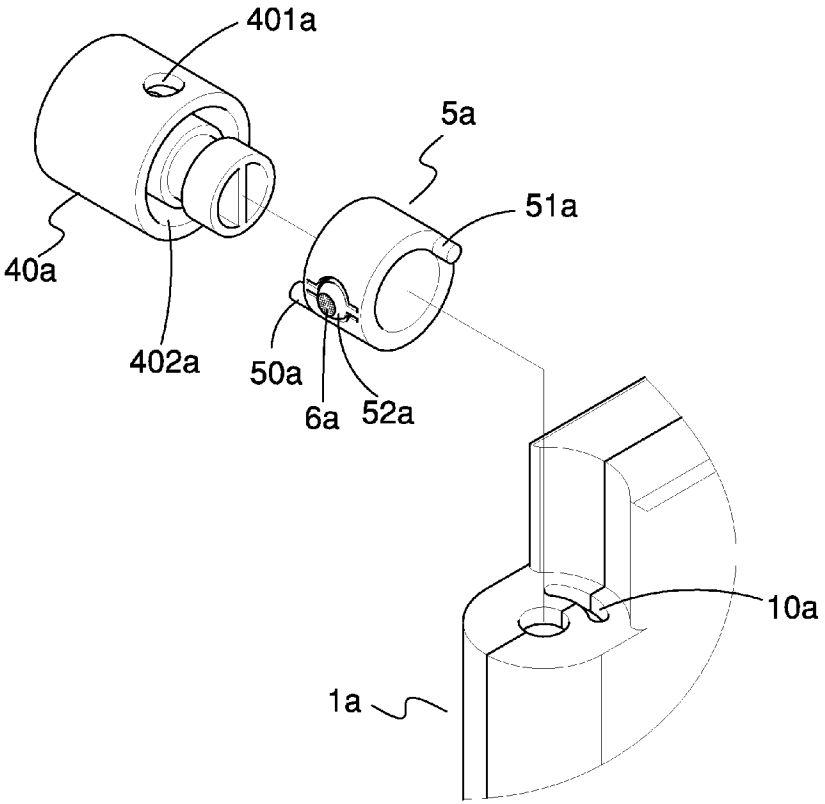
FIG. 12 is an exploded partial view of the padlock shown in FIG. 11.

Referring to FIG. 12, a shell 1*a* includes an arc-shaped slot 10*a*, and an indicator 5*a* includes a first side provided with a first post 50*a* and a second side provided with a second post 51*a* inserted in the slot 10*a* of the shell 1*a* in a sliding manner. The indicator 5*a* includes a periphery provided with an elastic protrusion 52*a* corresponding to the window 401*a* of the limit knob 40*a*, and the indication portion 6*a* is mounted on the elastic protrusion 52*a*.

Figure 13:
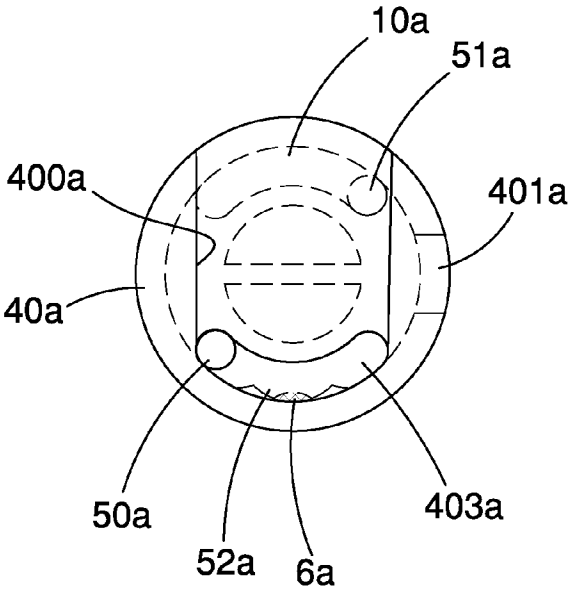
FIG. 13 is a top view of the padlock shown in FIG. 12.

Referring to FIG. 13, a recess 400*a* of a limit knob 40*a* includes an arc-shaped slot 403*a* in communication with a chamber 402*a*, and the first post 50*a* of an indicator 5*a* is inserted in the slot 403*a* of the limit knob 40*a* in a sliding manner.

Figure 14:
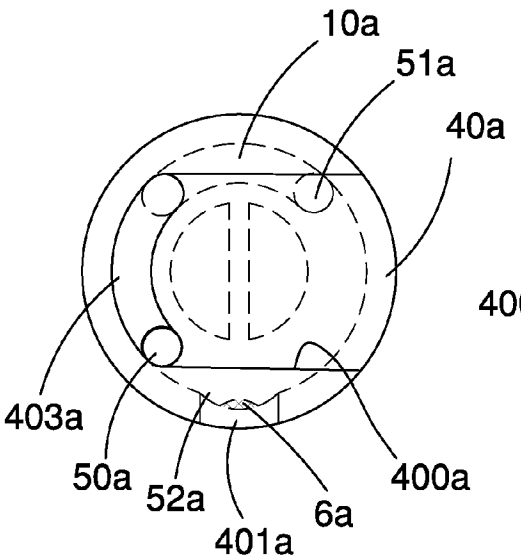
FIG. 14 is a top view of the padlock in another position than that is shown in FIG. 13.

Referring to FIG. 14, the limit knob 40*a* is rotated clockwise so that the recess 400*a* of the limit knob 40*a* is in the opened or unlocked state. At the time, the second post 51*a* of the indicator 5*a* is limited by a terminal side of the slot 10*a* of the shell 1*a* so that the indicator 5*a* is not moved with the limit knob 40*a*, while a window 401*a* of the limit knob 40*a* is moved and to aligned with the elastic protrusion 52*a* so that the indication portion 6*a* is exposed and visible from the window 401*a* of the limit knob 40*a*.

Figure 15:
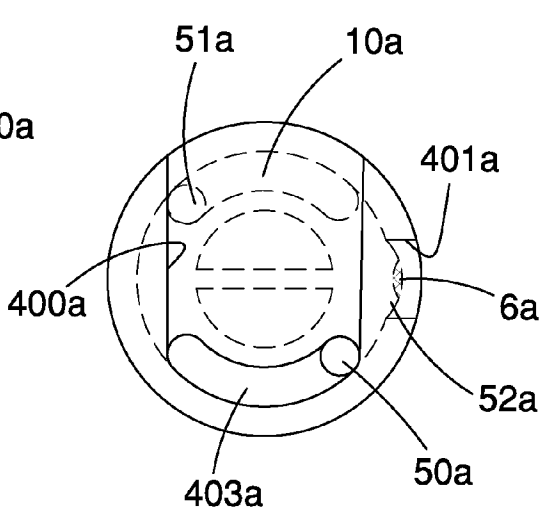
FIG. 15 is a top view of the padlock in another position than that is shown in FIG. 14.

Referring to FIG. 15, the limit knob 40*a* is rotated counterclockwise to the original position so that the recess 400*a* of the limit knob 40*a* is in the closed or locked state. At this time, the elastic protrusion 52*a* is inserted into the window 401*a* of the limit knob 40*a* so that the indicator 5*a* is moved with the limit knob 40*a*, and the indication portion 6*a* is still exposed from the window 401*a* of the limit knob 40*a*, which indicates that the lock mechanism 4*a* has been operated.

When the combination lock core 3*a* is unlocked, the shackle 2*a* is pulled outward and is rotate from the limit knob 40*a*. Then, a tool (not shown) can be inserted into the slot 403*a* of the limit knob 40*a* to cause the first post 50*a* of the indicator 5*a* to return to its original position so that the indication portion 6*a* is detached from the window 401*a* of the limit knob 40*a* and is hidden in the limit knob 40*a*.

Figure 16:
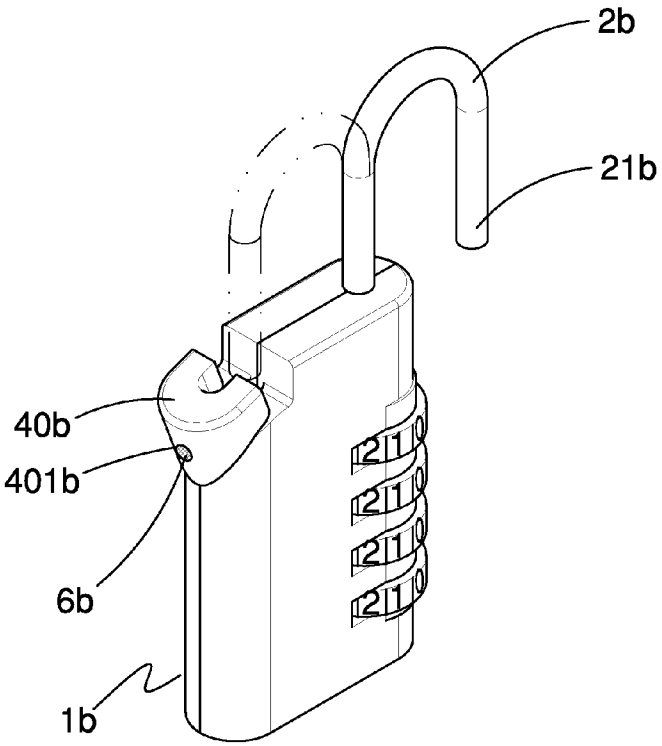
FIG. 16 is a perspective view of a padlock in accordance with a third embodiment of the present invention.

Referring to FIG. 16, a padlock in accordance with a third embodiment of the present invention includes a structure like that of the above embodiments. A limit knob 40*b* is pivotally mounted on an upper side of a shell 1*b* to limit a short section 21*b* of a shackle 2*b* so that the short section 21*b* of the shackle 2*b* is in a locked state, or release the short section 21*b* of the shackle 2*b* so that the short section 21*b* of the shackle 2*b* is in an unlocked state. When the short section 21*b* of the shackle 2*b* is in the unlocked state, the indication portion 6*b* is moved with the limit knob 40*b* and is visible from a window 401*b* of the limit knob 40*b*.

Figure 17:
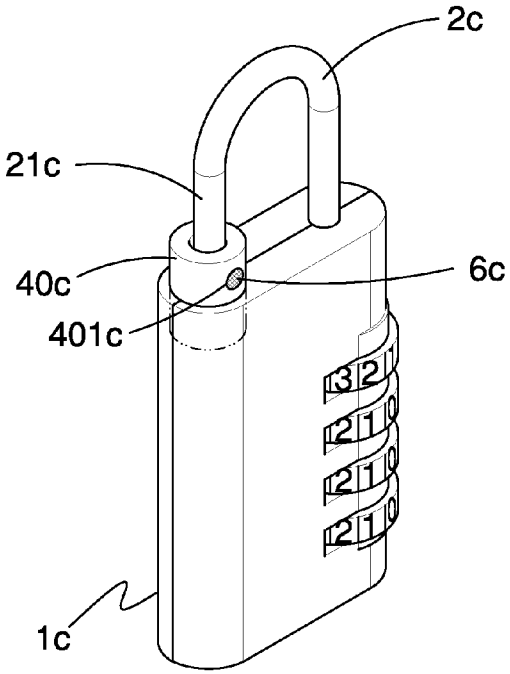
FIG. 17 is a perspective view of a padlock in accordance with a fourth embodiment of the present invention.

Referring to FIG. 17, a padlock in accordance with a fourth embodiment of the present invention includes a structure like that of the above embodiments. A limit knob 40*c* is retractably mounted on an upper side of a shell 1*c* to limit a short section 21*c* of a shackle 2*c* so that the short section 21*c* of the shackle 2*c* is in a locked state, or release the short section 21*c* of the shackle 2*c* so that the short section 21*c* of the shackle 2*c* is in an unlocked state. When the short section 21*c* of the shackle 2*c* is in the unlocked state, the indication portion 6*c* is moved with the limit knob 40*c* and exposed from a window 401*c* of the limit knob 40*c*.

Figure 19:
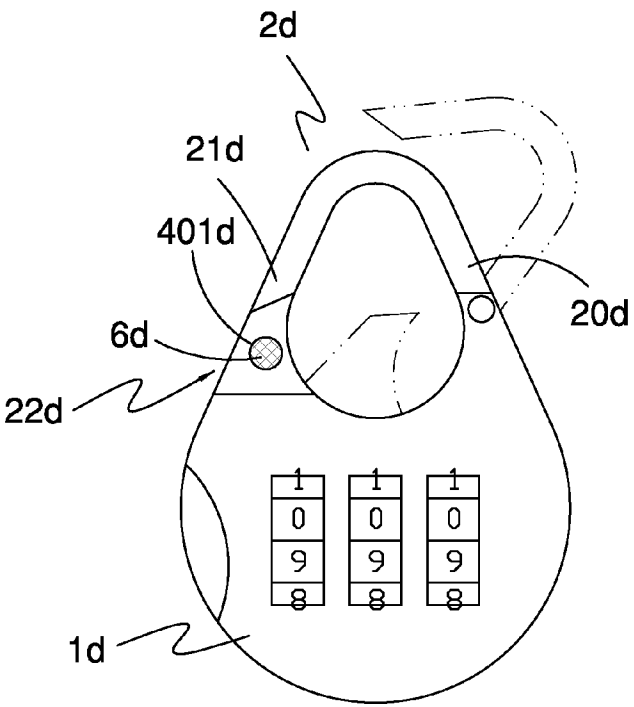
FIG. 19 is a front view of a padlock in accordance with a sixth embodiment of the present invention.
Figure 18:
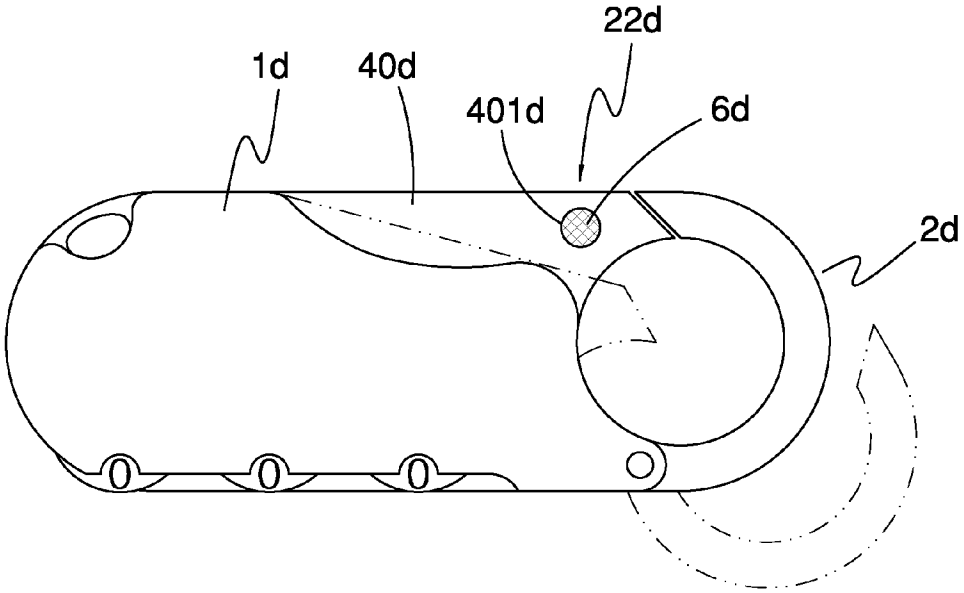
FIG. 18 is a front view of a padlock in accordance with a fifth embodiment of the present invention.

FIG. 18 shows a fifth embodiment of the present invention, and FIG. 19 shows a sixth embodiment of the present invention. Both embodiments respectively show a padlock includes a structure like that of the above embodiments. A long section 20*d* of a shackle 2*d* is pivotally mounted on a side of a shell 1*d*, and a gap 22*d* is defined between an end of a short section 21*d* of a shackle 2*d* and the shell 1*d*. A limit knob 40*d* is pivotally mounted on the shell 1*d* and inserted in the gap 22*d* to form a locked state. As the limit knob 40*d* is pressed towards the shell 1*d*, the gap 22*d* is opened to form an unlocked state so that the indication portion 6*d* is moved with the limit knob 40*d* and exposed from a window 401*d* of the limit knob 40*d*.

Figure 20:
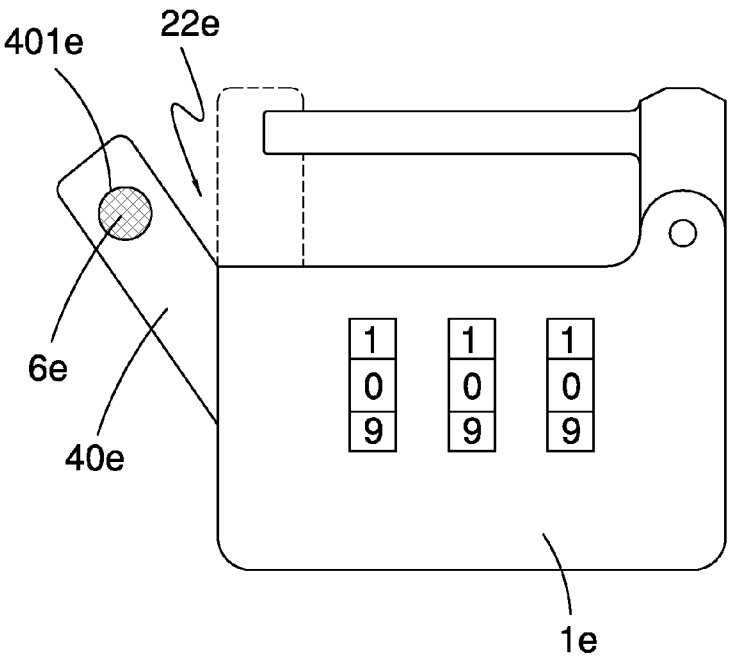
FIG. 20 is a front view of a padlock in accordance with a seventh embodiment of the present invention.

Referring to FIG. 20, a padlock in accordance with a seventh embodiment of the present invention includes a structure like that of the above embodiments. A limit knob 40*e* is pivotally mounted on the shell 1*e* and inserted in a gap 22*e* to form a locked state. When the limit knob 40*e* is moved outward relative to the shell 1*e*, the gap 22*e* is opened to form an unlocked state so that the indication portion 6*e* is moved with the limit knob 40*e* and exposed from a window 401*e* of the limit knob 40*e*.

Figure 21:
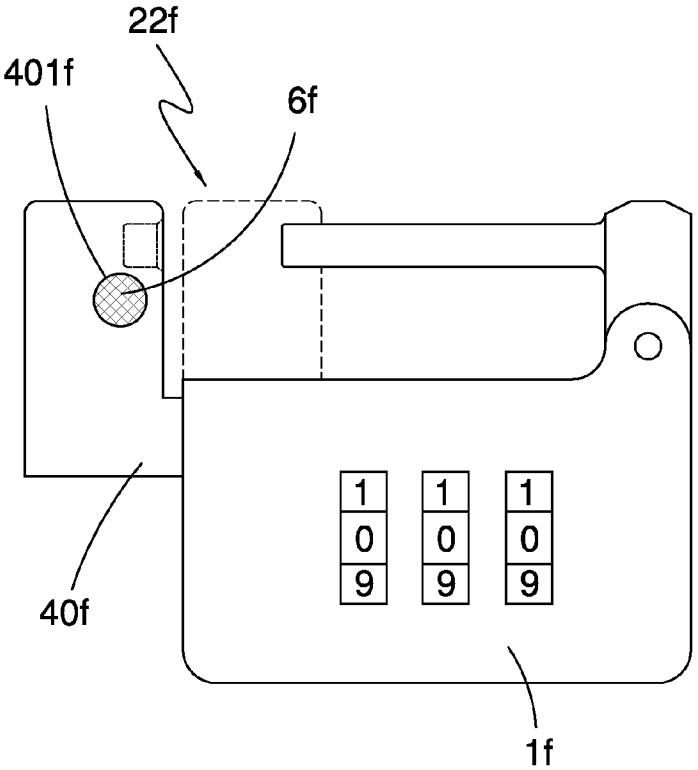
FIG. 21 is a front view of a padlock in accordance with an eighth embodiment of the present invention.

Referring to FIG. 21, a padlock in accordance with an eighth embodiment of the present invention includes a structure like that of the above embodiments. A limit knob 40*f* is linearly and movably mounted on a shell if and inserted in a gap 22*f* to form a locked state. As the limit knob 40*f* is linearly moved outward relative to the shell 1*f*, the gap 22*f* is opened to form an unlocked state so that an indication portion 6*f* is moved with the limit knob 40*f* and exposed from a window 401*f* of the limit knob 40*f*.

Figure 23:
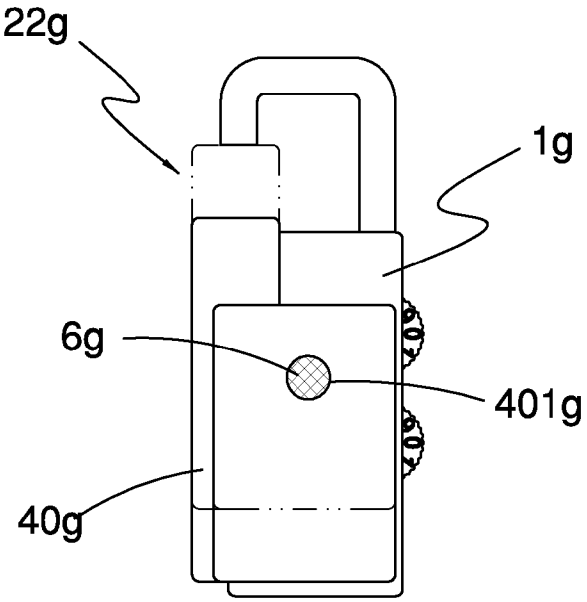
FIG. 23 is a front view of the padlock shown in FIG. 22.
Figure 22:
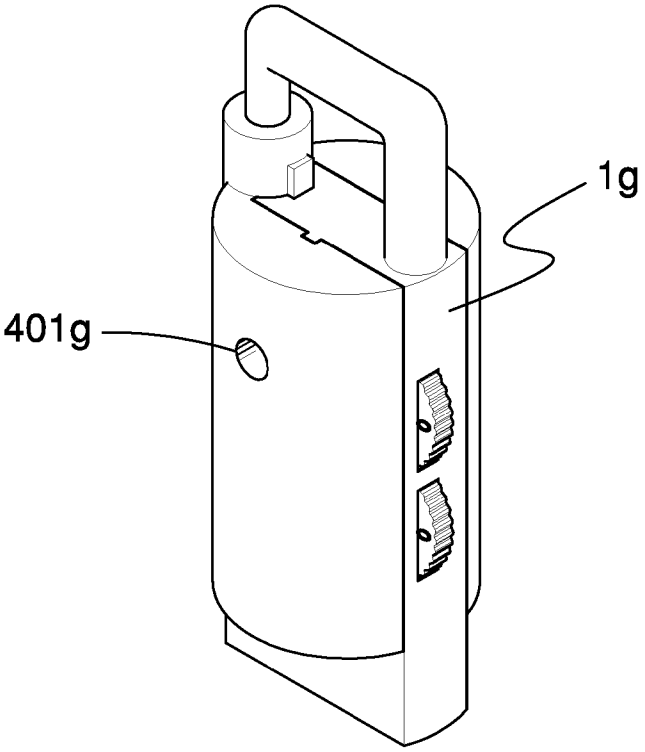
FIG. 22 is a perspective view of a padlock in accordance with a ninth embodiment of the present invention.

Referring to FIGS. 22 and 23, a padlock in accordance with a ninth embodiment of the present invention includes a structure like that of the above embodiments. A limit knob 40*g* is partially extended from a side of a shell 1*g* and is longitudinally movable on the shell 1*g* to open a gap 22*g* so as to form an unlocked state so that an indication portion 6*g* is moved with the limit knob 40*g* and exposed from a window 401*g* of the limit knob 40*g*.

Figure 24:
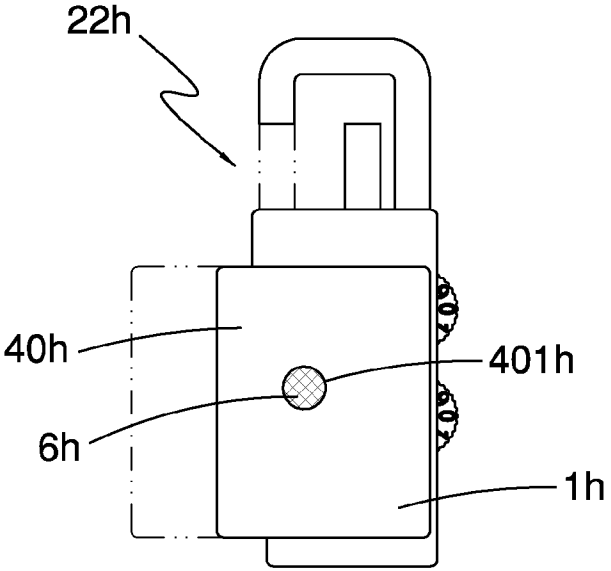
FIG. 24 is a front view of a padlock in accordance with a tenth embodiment of the present invention.

Referring to FIG. 24, a padlock in accordance with a tenth embodiment of the present invention includes a structure like that of the above embodiments. A limit knob 40*h* is transversely movable on a shell 1*h* to open a gap 22*h* so as to form an unlocked state so that an indication portion 6*h* is moved with the limit knob 40*h* and exposed from a window 401*h* of the limit knob 40*h*.

Figure 25:
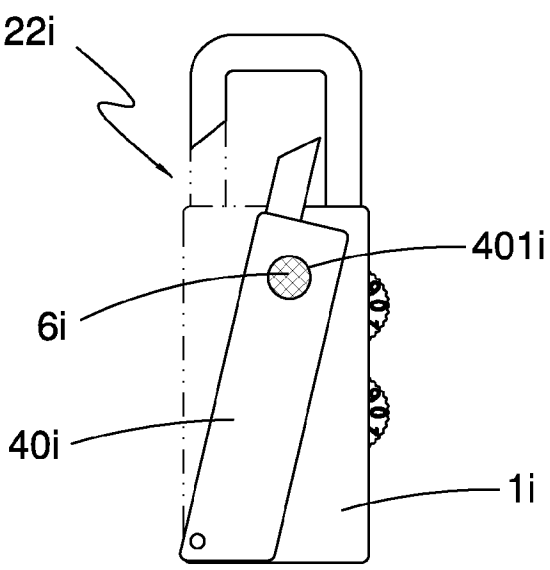
FIG. 25 is a front view of a padlock in accordance with an eleventh embodiment of the present invention.

Referring to FIG. 25, a padlock in accordance with an eleventh embodiment of the present invention includes a structure like that of the above embodiments. A limit knob 40*i* includes an end pivotally mounted on a bottom of a shell 1*i*. Thus, the limit knob 40*i* is pivoted on the shell 1*i* to open a gap 22*i* so as to form an unlocked state so that an indication portion 6*i* is moved with the limit knob 40*i* and exposed from a window 401*i* of the limit knob 40*i*.

After a customs inspector includes unlocked the padlock for checking the luggage, case or bag, the indication portion is exposed and visible from the window of the limit knob for reminding a padlock owner whose padlock has been operated or used and luggage may have been inspected by the customs inspector. In addition, the padlock owner can directly and easily judge if the customs inspector includes operated or used the padlock for checking the luggage. Furthermore, in the present invention, the indicator can be moved to the indication position not only by using the matching key to operate the lock core of the lock mechanism as above described, but also by any object which can reach or access to the lock core of the lock mechanism, especially the object which can reach or access to the indicator via the lock core, so as to further remind the padlock owner that the lock mechanism of the padlock has been used or touched.

In the foregoing embodiments, the indicator is inserted in the limit knob. However, in another embodiment or application, the indicator can be mounted outside the limit knob entirely or partially, and the window of the limit knob can be omitted. In the foregoing embodiments, the indicator can be moved in a linear manner, i.e., lifted and lowered. In another embodiment or application, the indicator can however be moved in an angular manner, i.e., pivoted. In the foregoing embodiments, the lock core of the lock mechanism can include a first member non-movably inserted in the shell of the padlock, and a second member movably inserted in the first member and can be rotated by the matching key. However, in another embodiment, the lock core of the lock mechanism can be a one-piece element movably inserted in the shell of the padlock and can be rotated by the matching key.

Although the invention has been explained in relation to the foregoing embodiments, it is to be understood that many modifications and variations can be made without departing from the scope of the present invention. It is contemplated that the appended claim or claims will cover such modifications and variations that fall within the true scope of the invention.

The invention claimed is:

1. A lock comprising:

a shell;

a shackle movably mounted on the shell and comprising a short section and a long section;

a first lock core inserted in the shell and movable between an unlocking position and a locking position, wherein the first lock core prevents rotation of the short section of the shackle about the long section of the shackle in the locking position;

a second lock core inserted in the shell and movable between an unlocking position and a locking position for preventing linear movement of the long section of the shackle;

an indicator operatively connected to the first lock core and movable between an original position and an indication position;

wherein the indicator is movable into the indication position from the original position by the first lock core when the first lock core is moved into the unlocking position from the locking position a first time before the long section of the shackle is linearly moved relative to the second lock core;

wherein the indicator is not returned into the original position from the indication position by the first lock core when the first lock core is returned into the locking position from the unlocking position;

wherein the indicator is kept in the indication position once the first lock core is moved into the unlocking position from the locking position; and wherein an end of the short section of the shackle is operable to return the indicator into the original position from the indication position.

2. A padlock, comprising:

a shell having opposite top and bottom side surfaces;

a button disposed outside the shell;

a shackle comprising a root section extending into the shell, an arch section extending upward from the root section to outside of the shell, and a free section extending downward from the arch section to be releasably engaged in the button;

a key lock core rotatably disposed in the shell between a first level and a second level for controlling movement of the shackle, wherein the first level is in line with the top side surface of the shell while the second level is in line with the bottom side surface of the shell; and an indicator disposed at the shell and being linearly movable with respect to the key lock core between the first level and a third level which is tangent to an apex of the arch section, wherein when the key lock core is operated by a key, the indicator is linearly moved from the first level toward the third level to an indication position outside the shell and in between the first and third levels; and once the indicator arrives in the indication position, the indicator is irresponsive to further key operation of the key lock core.

3. A padlock of claim 2, further comprising a combination lock core configured to control upward and downward movement of the shackle independent of the key lock core, and the key lock core controls the movement of the shackle independent of the combination lock core.

4. A padlock of claim 2, wherein the key lock core has a rotor defining a keyhole therein; the indicator, the free section of the shackle and the rotor of the key lock core are in line with one another; and the indicator is disposed in between the free section of the shackle and the rotor of the key lock core.

5. A padlock of claim 4, further comprising a combination lock core configured to control upward and downward movement of the shackle independent of the key lock core, and the key lock core controls the movement of the shackle independent of the combination lock core.

6. A padlock, comprising:

a shell defining first, second and third openings therein;

a limit knob partly disposed outside the shell and partly inserted in the second opening of the shell;

a shackle including a long section inserted in the first opening of the shell an arch section extending upward from the long section to outside of the shell, and a short section extending downward from the arch section to be releasably engaged in the limit knob;

a first level, being in line with a top side surface of the shell;

a second level, being in line with a bottom surface of the shell;

a third level, being tangent to an apex of the arch section of the shackle;

a key lock core disposed in the third opening of the shell and located between the first level and the second level, and configured to control whether the short section of the shackle can be rotated about the long section of the shackle; and an indicator being movable between the first level and the third level, wherein when the key lock core is operated by a key, the indicator moves from the first level toward the third level to an indication position for indicating whether the key lock core has been operated, and when the second opening of the shell is inserted by a tool, the indicator returns from the indication position back to the first level.

7. A padlock of claim 6, wherein the tool is the short section of the shackle.

8. A padlock of claim 6, wherein when the key lock core is operated by the key to unlock the padlock, the indicator moves to the indication position; and when the key lock core is further operated by the key to re-lock the padlock, the indicator remains in the indication position.

* * * * *